US010083643B2

(12) United States Patent
Kondo

(10) Patent No.: US 10,083,643 B2
(45) Date of Patent: Sep. 25, 2018

(54) DISPLAY DEVICE AND TRANSMISSION PROCESSING METHOD FOR IMAGE DATA SIGNAL

(71) Applicant: LAPIS Semiconductor Co., Ltd., Yokohama (JP)

(72) Inventor: Hironori Kondo, Yokohama (JP)

(73) Assignee: LAPIS Semiconductor Co., Ltd., Yokohama (JP)

( * ) Notice: Subject to any disclaimer, the term of this patent is extended or adjusted under 35 U.S.C. 154(b) by 500 days.

(21) Appl. No.: 14/829,240

(22) Filed: Aug. 18, 2015

(65) Prior Publication Data

US 2016/0055785 A1 Feb. 25, 2016

(30) Foreign Application Priority Data

Aug. 19, 2014 (JP) ..... 2014-167003

(51) Int. Cl.
*G09G 3/20* (2006.01)

(52) U.S. Cl.
CPC ..... *G09G 3/20* (2013.01); *G09G 2310/027* (2013.01); *G09G 2370/08* (2013.01)

(58) Field of Classification Search
None
See application file for complete search history.

(56) References Cited

U.S. PATENT DOCUMENTS 8,063,871 B2 * 11/2011 Lee ..... G09G 3/3406 345/102
2003/0053098 A1 * 3/2003 Hagai ..... H04N 1/40087 358/1.9
2003/0085906 A1 * 5/2003 Elliott ..... G09G 3/20 345/613
2005/0069168 A1 * 3/2005 Zarrabizadeh ..... G06T 1/0028 382/100
2005/0157581 A1 * 7/2005 Shiurasaki ..... G09G 3/325 365/230.06
2006/0208987 A1 * 9/2006 Sarayeddine ..... G02F 1/136 345/98

FOREIGN PATENT DOCUMENTS

JP 2000-194305 A 7/2000

* cited by examiner

*Primary Examiner* — Jennifer Mehmood
*Assistant Examiner* — Paul Gupta
(74) *Attorney, Agent, or Firm* — Rabin & Berdo, P.C.

(57) ABSTRACT

A transmission image data signal including: a coded data block obtained by performing an error correction coding on a sequence of pixel data pieces in input image data; and a representative pixel data pieces group containing three pixel data pieces corresponding to red, green, and blue, respectively, in the sequence of the pixel data pieces is transmitted to a driver in a display panel. The driver converts the sequence of the pixel data pieces obtained by performing an error correction on the transmission image data signal to pixel driving voltages and applies these voltages to the display panel. If pixels for one horizontal scanning line have an identical color, the driver performs no error correction. Instead, the driver converts the representative pixel data pieces group to pixel driving voltages and applies these voltages to the display panel.

12 Claims, 6 Drawing Sheets

DISPLAY DEVICE AND TRANSMISSION PROCESSING METHOD FOR IMAGE DATA SIGNAL

BACKGROUND OF THE INVENTION

1. Field of the Invention

The present invention relates to a display device and a transmission processing method for an image data signal in the display device.

2. Related Art

Liquid crystal display devices as display devices each include, in addition to a liquid crystal display panel, a plurality of data drivers for driving the liquid crystal display panel and a control unit for transmitting image data to the respective drivers. In recent years, liquid crystal display panels have had increasingly higher resolution in order to display increasingly higher definition images. The transmission frequency of image data in such a liquid crystal display device has been increasing accordingly. Thus, there is concern about an increase in power consumption associated with an increase in the transmission frequency.

In view of this, a data driver that achieves a lower power consumption by, when display line data of adjacent display lines are identical to each other among display data, stopping the sending of a voltage for driving a liquid crystal display panel to the liquid crystal display panel has been proposed (see, for example, Japanese Patent Application Laid-open No. 2000-194305).

However, there is a risk of causing electro-magnetic interference, what is called EMI, along with an increase in the transmission frequency of image data in the display device and thus generating an error in the image data received at the driver. This deteriorates the display quality of the image.

SUMMARY OF THE INVENTION

It is an object of the present invention to provide a display device and an image data signal transmission processing method capable of suppressing a deterioration in display quality and an increase in power consumption.

A display device according to the present invention is a display device for displaying, on a display panel, an image based on input image data including a sequence of pixel data pieces indicating luminance levels corresponding to red, green, and blue of respective pixels. The display device includes: a driver for applying pixel driving voltages to a plurality of data lines in the display panel; and a control unit for generating a transmission image data signal on the basis of the input image data and transmitting the transmission image data signal to the driver. The control unit includes: an identical color line detecting unit for generating, for each horizontal scanning line, identical color line data indicating whether the pixels for one horizontal scanning line have an identical color on the basis of the sequence of the pixel data pieces in the input image data; a representative pixel extracting unit for extracting, as a representative pixel data pieces group, three pixel data pieces corresponding to red, green, and blue, respectively, from among the sequence of the pixel data pieces; an error correction coding unit for performing an error correction coding process on the sequence of the pixel data pieces to generate a coded data block; and a transmitting unit for generating the transmission image data signal including the identical color line data, the representative pixel data pieces group, and the coded data block and transmitting the transmission image data signal to the driver. If the identical color line data in the transmission image data signal received indicates not having the identical color, the driver converts the pixel data pieces obtained by performing an error correction process on the coded data block in the transmission image data signal to the respective pixel driving voltages. If the identical color line data indicates having the identical color, the driver converts the pixel data pieces contained in the representative pixel data pieces group in the transmission image data signal to the respective pixel driving voltages.

A transmission processing method for an image data signal according to the present invention is a transmission processing method for an image data signal in a display device for displaying, on a display panel, an image based on input image data including a sequence of pixel data pieces indicating luminance levels corresponding to red, green, and blue of respective pixels. The method includes: a first step of generating, for each horizontal scanning line, identical color line data indicating whether the pixels for one horizontal scanning line have an identical color on the basis of the sequence of the pixel data pieces in the input image data; a second step of extracting, as a representative pixel data pieces group, three pixel data pieces corresponding to red, green, and blue, respectively, from among the sequence of the pixel data pieces; a third step of performing an error correction coding process on the sequence of the pixel data pieces to generate a coded data block; a fourth step of generating a transmission image data signal including the identical color line data, the representative pixel data pieces group, and the coded data block; a fifth step of determining whether the identical color line data in the transmission image data signal indicates having the identical color or not having the identical color; and a sixth step of converting, if the identical color line data indicates not having the identical color, the pixel data pieces obtained by performing an error correction process on the coded data block in the transmission image data signal to respective pixel driving voltages and applying the pixel driving voltages to the display panel or converting, if the identical color line data indicates having the identical color, the pixel data pieces contained in the representative pixel data pieces group in the transmission image data signal to the respective pixel driving voltages and applying the pixel driving voltages to the display panel.

According to the present invention, the transmission image data signal including: the coded data block obtained by performing the error correction coding process on the sequence of the pixel data pieces in the input image data; and the representative pixel data pieces group containing the three pixel data pieces corresponding to red, green, and blue, respectively, in the sequence of the pixel data pieces is transmitted to the driver in the display panel. The driver converts the sequence of the pixel data pieces obtained by performing the error correction process on the transmission image data signal to the pixel driving voltages and applies these voltages to the display panel.

Thus, even when an error is generated in the image data received at the driver due to the EMI caused by an increase in the transmission frequency of the image data in the display device, an image with high display quality can be displayed since such an error is corrected.

If all pixels for one horizontal scanning line have the identical color, no error correction process as described above is performed. Instead, the representative pixel data pieces contained in the transmission image data signal is converted to pixel driving voltages and these voltages are applied to the display panel. Thus, at this time, a power consumption can be reduced by an amount necessary to perform the error correction process.

Thus, according to the present invention, a deterioration in display quality associated with an increase in the transmission frequency of image data in the display device and an increase in power consumption can be suppressed.

DETAILED DESCRIPTION OF EMBODIMENTS

Figure 1:
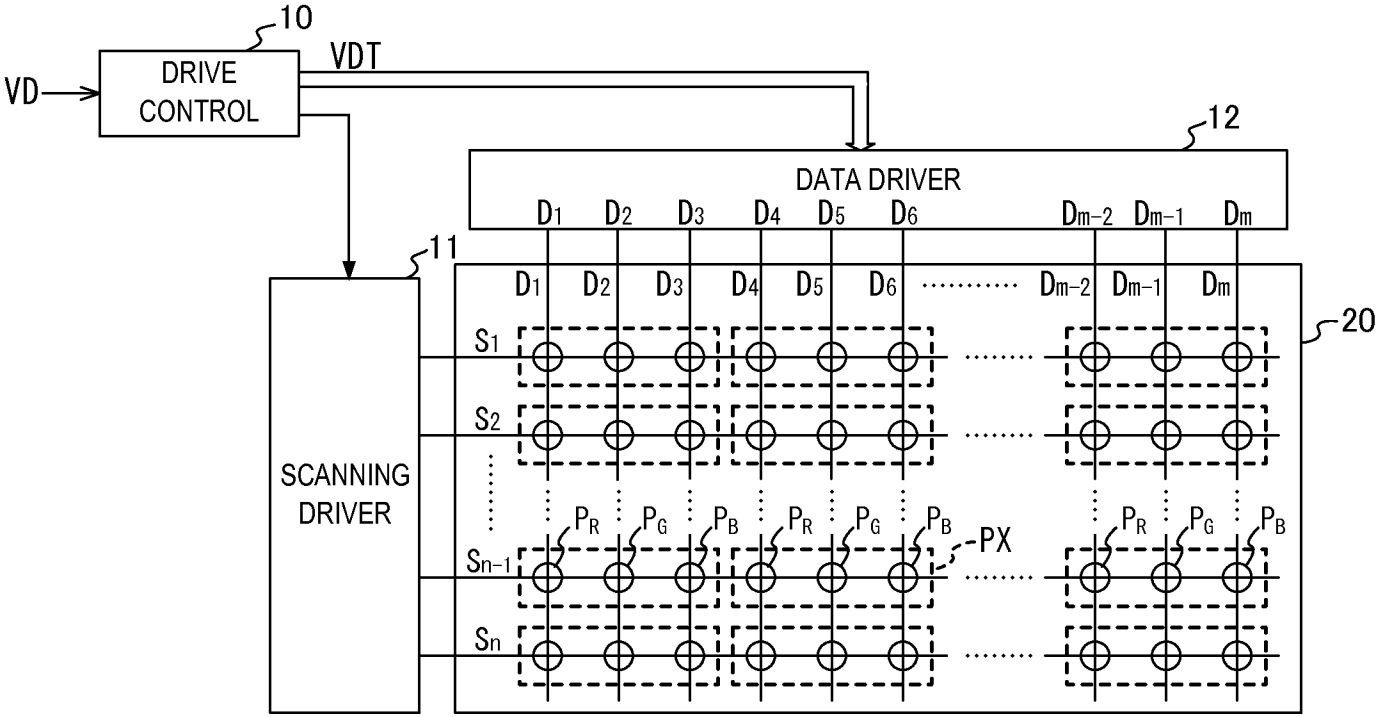
FIG. 1 is a diagram illustrating a general configuration of a display device according to the present invention.

FIG. 1 is a diagram illustrating a general configuration of a display device according to the present invention.

In FIG. 1, a display panel 20 as a liquid crystal panel, for example, includes: a liquid crystal layer (not shown); "n" (n is an integer larger than or equal to 2) horizontal scanning lines $S_1$ to $S_n$ extending in a horizontal direction of a two-dimensional screen; and "m" (m is an integer larger than or equal to 2) data lines $D_1$ to $D_m$ extending in a vertical direction of the two-dimensional screen. A red display cell $P_R$ for red display, a green display cell $P_G$ for green display, or a blue display cell $P_B$ for blue display is formed at an intersection between one horizontal scanning line and one data line. More specifically, among the data lines $D_1$ to $D_m$, the red display cells $P_R$ are formed in the $(3 \cdot t-2)$th data lines (t is a natural number), i.e., $D_1$, $D_4$, $D_7$, . . . , and $D_{m-2}$. Among the data lines $D_1$ to $D_m$, the green display cells $P_G$ are formed in the $(3 \cdot t-1)$th data lines, i.e., $D_2$, $D_5$, $D_8$, . . . , and $D_{m-1}$. Among the data lines $D_1$ to $D_m$, the blue display cells $P_B$ are formed in the $(3 \cdot t)$th data lines, i.e., $D_3$, $D_6$, $D_9$, . . . , and $D_m$.

As shown in FIG. 1, on each of the horizontal scanning lines $S_1$ to $S_n$ three display cells adjacent to one another, i.e., the red display cell $P_R$, the green display cell $P_G$, and the blue display cell $P_B$, form one pixel PX (a region defined by a broken line).

A drive control unit 10 generates a scanning control signal synchronized with input image data VD and provides the scanning control signal to a scanning driver 11.

Figure 2:
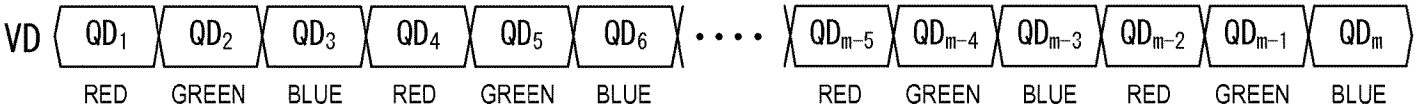
FIG. 2 is a diagram illustrating one example of a format of input image data VD.

As shown in FIG. 2, for example, the input image data VD is constituted by a sequence of pixel data pieces (hereinafter, also simply referred to as pixel data) $QD_1$ to $QD_m$ indicating, for each horizontal scanning line, luminance levels for red, green, and blue components of the respective pixels in the display panel 20 by 8 bits, for example. In the sequence of the pixel data $QD_1$ to $QD_m$, the pixel data $QD_1$, $QD_4$, $QD_7$, . . . , $QD_{m-5}$, and $QD_{m-2}$, i.e., the $(3 \cdot t-2)$th pixel data QD each indicate a luminance level of a red component. In the sequence of the pixel data $QD_1$ to $QD_m$, the pixel data $QD_2$, $QD_5$, $QD_8$, . . . , $QD_{m-4}$, and $QD_{m-1}$, i.e., the $(3 \cdot t-1)$th pixel data QD each indicate a luminance level of a green component. In the sequence of the pixel data $QD_1$ to $QD_m$, the pixel data $QD_3$, $QD_6$, $QD_9$, . . . , $QD_{m-3}$, and $QD_m$, i.e., the $(3 \cdot t)$th pixel data QD each indicate a luminance level of a blue component.

The drive control unit 10 generates a transmission image data signal VDT on the basis of the input image data VD and transmits the transmission image data signal VDT to a data driver 12. An operation of generating the transmission image data signal VDT by the drive control unit 10 will be described later.

The scanning driver 11 generates a scanning pulse in accordance with the scanning control signal provided by the drive control unit 10. The scanning driver 11 then applies the scanning pulse to the horizontal scanning lines $S_1$ to $S_n$ of the display panel 20 in a sequential and alternative manner.

The data driver 12 is formed in a single semiconductor chip or formed dispersedly in a plurality of semiconductor chips.

The data driver 12 first decodes the received transmission image data signal VDT to restore the sequence of the pixel data QD shown in FIG. 2. The decoding process by the data driver 12 will be described later in detail. The data driver 12 sequentially takes in and keeps the restored sequence of the pixel data QD. Every time taking in of the pixel data QD for one horizontal scanning line, i.e., m pieces of pixel data QD is completed, the data driver 12 converts the m pieces of pixel data QD to analog voltages corresponding to the luminance levels indicated by the pixel data QD. The data driver 12 then applies these analog voltages to the data lines $D_1$ to $D_m$ of the display panel 20 as pixel driving voltages $G_1$ to $G_m$.

An operation of generating and transmitting the transmission image data signal VDT by the drive control unit 10 and an operation of the data driver 12 will be described below.

Figure 3:
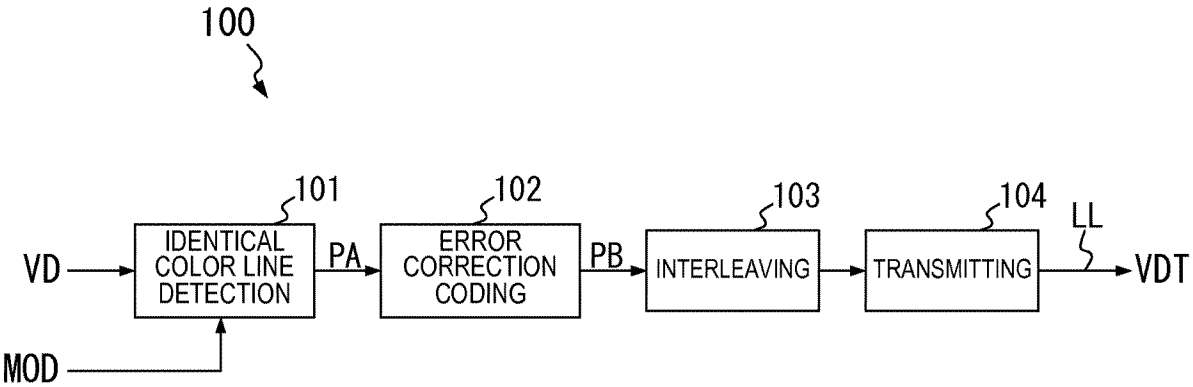
FIG. 3 is a block diagram illustrating an internal configuration of a transmission image data signal generating unit 100.

The drive control unit 10 includes a transmission image data signal generating unit 100 for generating and transmitting the transmission image data signal VDT. FIG. 3 is a block diagram illustrating an example of an internal configuration of the transmission image data signal generating unit 100. As shown in FIG. 3, the transmission image data signal generating unit 100 includes: an identical color line detecting unit 101; an error correction coding unit 102; an interleaving unit 103; and a transmitting unit 104.

Figure 4:
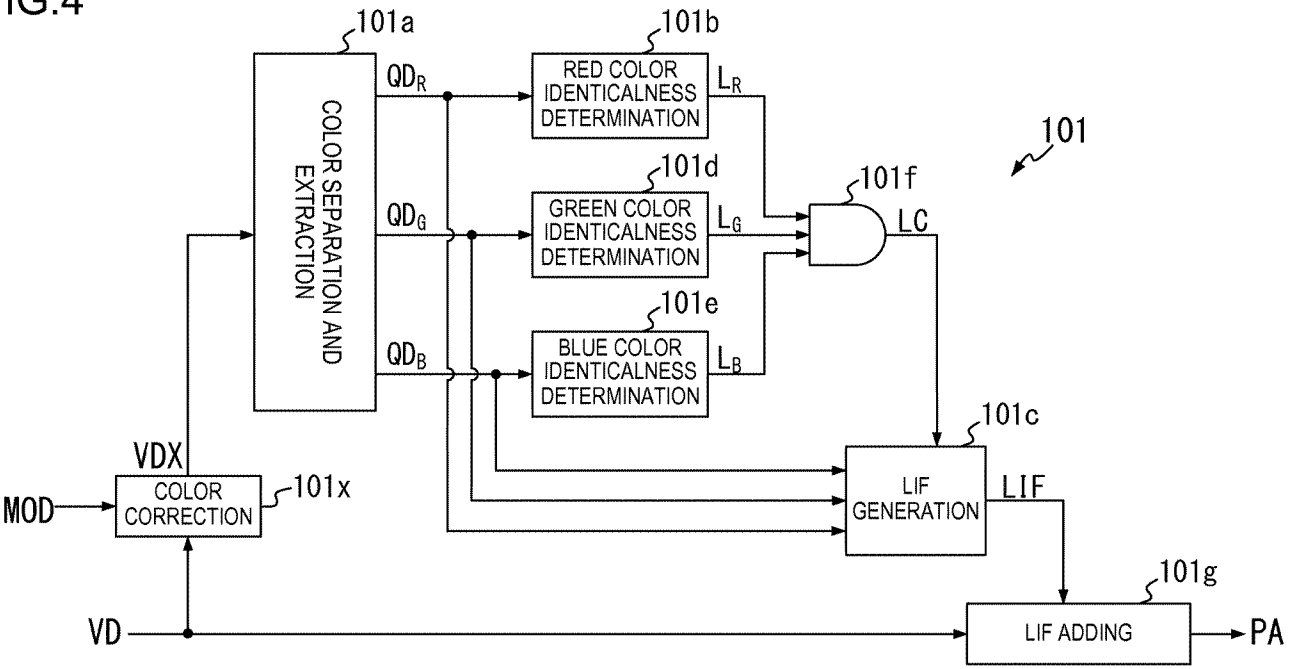
FIG. 4 is a block diagram illustrating an internal configuration of an identical color line detecting unit 101.

The identical color line detecting unit 101 has an internal configuration shown in FIG. 4, for example. In FIG. 4, when a mode signal MOD indicates a high-definition mode, a color correcting unit 101*x* provides the input image data VD as it is to a color separation and extraction unit 101*a* as image data VDX. When the mode signal MOD indicates a low power consumption mode, the color correcting unit 101*x* provides the input image data VD, which has undergone the following correction, to the color separation and extraction unit 101*a* as the image data VDX.

More specifically, in the low power consumption mode, the color correcting unit 101*x* first determines, for each horizontal scanning line, color frequencies expressed by the respective pixels on the basis of the input image data VD. Next, the color correcting unit 101*x* sets, as a reference color, the color having the highest frequency, i.e., the most frequent color among the colors expressed by the pixels for one horizontal scanning line. If there are a plurality of most frequent colors, the color correcting unit 101*x* sets an average color of the pixels for one horizontal scanning line as the above-described reference color on the basis of the input image data VD.

Next, for each of the pixels for one horizontal scanning line, the color correcting unit 101*x* determines a difference between the color expressed by the pixel and the reference color. More specifically, for each of the color components (red, green, and blue), the color correcting unit 101*x* determines differences between luminances of red, green, and blue components in the reference color (hereinafter referred to as a reference red luminance, a reference green luminance, and a reference blue luminance, respectively) and luminances of red, green, and blue components in each pixel based on the input image data VD. Hereinafter, a difference with respect to the reference red luminance is referred to as a red difference, a difference with respect to the reference green luminance as a green difference, and a difference with respect to the reference blue luminance as a blue difference.

Next, the color correcting unit 101*x* determines, for each pixel, whether all of the color differences constituted by the red difference, the green difference, and the blue difference fall within a predetermined range, e.g., within a range of −5% to +5% (i.e., ±5%) of the maximum luminance. The color correcting unit 101*x* may determine, for each pixel, whether the sum of the red difference, the green difference, and the blue difference falls within a range of −10% to +10% (±10%) of the maximum luminance, for example.

If it is determined that each color component difference falls within the predetermined range, the color correcting unit 101*x* then performs correction of replacing the luminance levels indicated by the pixel data QD for the color components corresponding to that pixel with values of the luminance levels of the color components in the reference color, respectively. If it is determined that each color component difference does not fall within the predetermined range, the color correcting unit 101*x* then performs no correction as described above on the pixel data QD for the color components corresponding to that pixel.

The color correcting unit 101*x* provides the pixel data QD in the input image data VD, each having undergone the process as described above, to the color separation and extraction unit 101*a* as the image data VDX.

The color separation and extraction unit 101*a* extracts the pixel data QD each indicating a luminance level of the red component as red pixel data $QD_R$ from among the sequence of the pixel data QD indicated by the image data VDX. More specifically, the color separation and extraction unit 101*a* extracts the (3·t−2)th pixel data $QD_1$, $QD_4$, $QD_7$, . . . , $QD_{m-5}$, and $QD_{m-2}$ as the red pixel data $QD_R$ from among the sequence of the pixel data QD shown in FIG. 2. The color separation and extraction unit 101*a* provides the sequence of the obtained red pixel data $QD_R$ to a red color identicalness determination unit 101*b* and an LIF generating unit 101*c*.

The color separation and extraction unit 101*a* extracts the pixel data QD each indicating a luminance level of the green component as green pixel data $QD_G$ from among the sequence of the pixel data QD indicated by the image data VDX. More specifically, the color separation and extraction unit 101*a* extracts the (3·t−1)th pixel data $QD_2$, $QD_5$, $QD_8$, . . . , $QD_{m-4}$, and $QD_{m-1}$ as the green pixel data $QD_G$ from among the sequence of the pixel data QD shown in FIG. 2. The color separation and extraction unit 101*a* provides the sequence of the obtained green pixel data $QD_G$ to a green color identicalness determination unit 101*d* and the LIF generating unit 101*c*.

Furthermore, the color separation and extraction unit 101*a* extracts the pixel data QD each indicating a luminance level of the blue component as blue pixel data $QD_B$ from among the sequence of the pixel data QD indicated by the image data VDX. More specifically, the color separation and extraction unit 101*a* extracts the (3·t)th pixel data $QD_3$, $QD_6$, $QD_9$, . . . , $QD_{m-3}$, and $QD_m$ as the blue pixel data $QD_B$ from among the sequence of the pixel data QD shown in FIG. 2. The color separation and extraction unit 101*a* provides the sequence of the obtained blue pixel data $QD_B$ to a blue color identicalness determination unit 101*e* and the LIF generating unit 101*c*.

The red color identicalness determination unit 101*b* determines whether or not the red pixel data $QD_R$ for one horizontal scanning line, i.e., the pixel data $QD_1$, $QD_4$, $QD_7$, . . . , $QD_{m-5}$, and $QD_{m-2}$ have the same luminance level. If it is determined that the red pixel data $QD_R$ for one horizontal scanning line are identical to one another, the red color identicalness determination unit 101*b* provides a red color conformity determination signal $L_R$ at a logic level of 1 to an AND gate 101*f*. If it is determined that not all of the red pixel data $QD_R$ for one horizontal scanning line are identical to one another, the red color identicalness determination unit 101*b* provides a red color conformity determination signal $L_R$ at a logic level of 0 to the AND gate 101*f*.

The green color identicalness determination unit 101*d* determines whether or not the green pixel data $QD_G$ for one horizontal scanning line, i.e., the pixel data $QD_2$, $QD_5$, $QD_8$, . . . , $QD_{m-4}$, and $QD_{m-1}$ have the same luminance level. If it is determined that the green pixel data $QD_G$ for one horizontal scanning line are identical to one another, the green color identicalness determination unit 101*d* provides a green color conformity determination signal $L_G$ at a logic level of 1 to the AND gate 101*f*. If it is determined that not all of the green pixel data $QD_G$ for one horizontal scanning line are identical to one another, the green color identicalness determination unit 101*d* provides a green color conformity determination signal $L_G$ at a logic level of 0 to the AND gate 101*f*.

The blue color identicalness determination unit 101*e* determines whether or not the blue pixel data $QD_B$ for one horizontal scanning line, i.e., the pixel data $QD_3$, $QD_6$, $QD_9$, . . . , $QD_{m-3}$, and $QD_m$ have the same luminance level. If it is determined that the blue pixel data $QD_B$ for one horizontal scanning line are identical to one another, the blue color identicalness determination unit 101*e* provides a blue color conformity determination signal $L_B$ at a logic level of 1 to the AND gate 101*f*. If it is determined that not all of the blue pixel data $QD_B$ for one horizontal scanning line are identical to one another, the blue color identicalness determination unit 101*e* provides a blue color conformity determination signal $L_B$ at a logic level of 0 to the AND gate 101*f*.

The AND gate 101*f* provides identical color line data LC having a logic level of 1 to the LIF generating unit 101*c* if all of the red color conformity determination signal $L_R$, the green color conformity determination signal $L_G$, and the blue color conformity determination signal $L_B$ have the logic level of 1. At all other times, the AND gate 101*f* provides identical color line data LC having a logic level of 0 to the LIF generating unit 101*c*.

More specifically, in the high-definition mode, the AND gate 101*f* provides the identical color line data LC at the logic level of 1 to the LIF generating unit 101*c* if all pixels PX for one horizontal scanning line have an identical color (hereinafter referred to as "identical-color-throughout-one-line"). If not all of the pixels PX have an identical color, the AND gate 101*f* provides the identical color line data LC at the logic level of 0 to the LIF generating unit 101*c*. In the low power consumption mode, the AND gate 101*f* provides the identical color line data LC at the logic level of 1 to the LIF generating unit 101*c* if all of the color differences between the reference color most frequent among the colors expressed by the pixels PX for one horizontal scanning line and the colors expressed by the pixels PX for this one horizontal scanning line fall within the predetermined range. At all other times, the AND gate 101*f* provides the identical color line data LC at the logic level of 0 to the LIF generating unit 101*c*.

Figure 5:
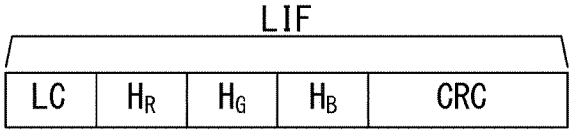
FIG. 5 is a diagram illustrating a data format of line information LIF.

The LIF generating unit 101*c* generates line information LIF having a data format shown in FIG. 5 on the basis of the identical color line data LC, the red pixel data $QD_R$, the green pixel data $QD_G$, and the blue pixel data $QD_B$. The LIF generating unit 101*c* then keeps the line information LIF in a built-in register (not shown).

More specifically, the LIF generating unit 101*c* first keeps the identical color line data LC provided by the AND gate 101*f* in the built-in register. Next, the LIF generating unit 101*c* keeps one of the red pixel data $QD_R$ provided by the color separation and extraction unit 101*a* in the built-in register as representative red pixel data $H_R$. The LIF generating unit 101*c* keeps one of the green pixel data $QD_G$ provided by the color separation and extraction unit 101*a* in the built-in register as representative green pixel data $H_G$. The LIF generating unit 101*c* keeps one of the blue pixel data $QD_B$ provided by the color separation and extraction unit 101*a* in the built-in register as representative blue pixel data $H_B$.

Furthermore, the LIF generating unit 101*c* performs an error detection coding process by means of CRC (Cyclic Redundancy Check), for example, on a data block constituted by the identical color line data LC, the representative red pixel data $H_R$, the representative green pixel data $H_G$, and the representative blue pixel data $H_B$ kept in the built-in register. The LIF generating unit 101*c* keeps error check data CRC obtained by the error detection coding process in the built-in register.

The LIF generating unit 101*c* provides the line information LIF constituted by the identical color line data LC, the representative red pixel data $H_R$, the representative green pixel data $H_G$, the representative blue pixel data $H_B$, and the error check data CRC kept in the built-in register to an LIF adding unit 101*g*.

Figure 6:
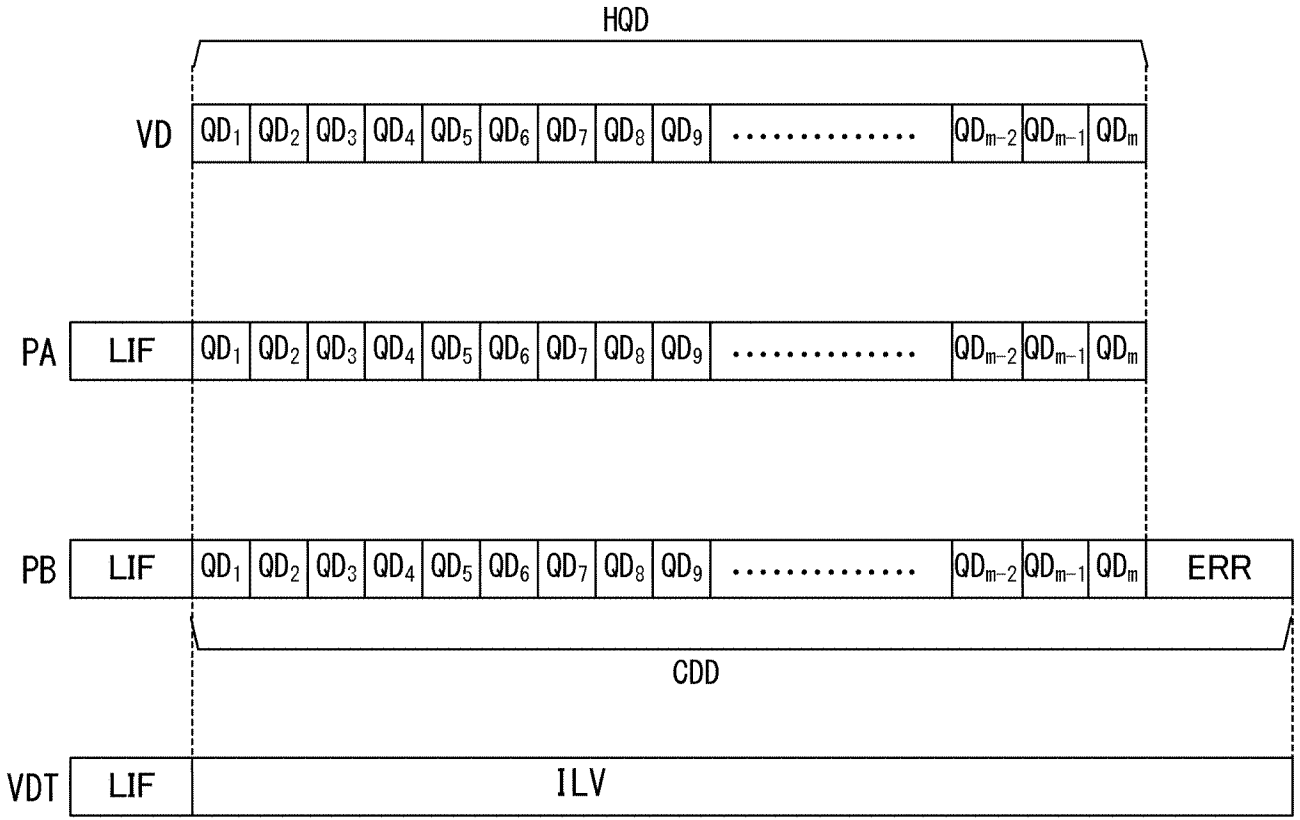
FIG. 6 is a diagram illustrating data formats of transmitted intermediate image data PA and PB and a transmission image data signal VDT.

As shown in FIG. 6, the LIF adding unit 101*g* adds the line information LIF to the head of each pixel data block HQD made up of the pixel data $QD_1$ to $QD_m$ for one horizontal scanning line in the input image data VD so as to generate transmission intermediate image data PA.

Thus, with the configuration shown in FIG. 4, the identical color line detecting unit 101 generates the transmission intermediate image data PA shown in FIG. 6 on the basis of the input image data VD and provides the transmission intermediate image data PA to the error correction coding unit 102.

The error correction coding unit 102 performs an error correction coding process on the pixel data block HQD in the transmission intermediate image data PA to generate a coded data block CDD in which error correction code data ERR is added to the HQD. As shown in FIG. 6, the error correction coding unit 102 provides transmission intermediate image data PB having the line information LIF in front of the coded data block CDD to the interleaving unit 103.

The interleaving unit 103 performs, on the coded data block CDD in the transmission intermediate image data PB shown in FIG. 6, an interleaving process that changes a data array thereof to obtain a coded data block ILV.

The transmitting unit 104 transmits the transmission image data signal VDT constituted by a data sequence including the line information LIF and the coded data block ILV as shown in FIG. 6 to the data driver 12 via a transmission line LL.

Figure 7:
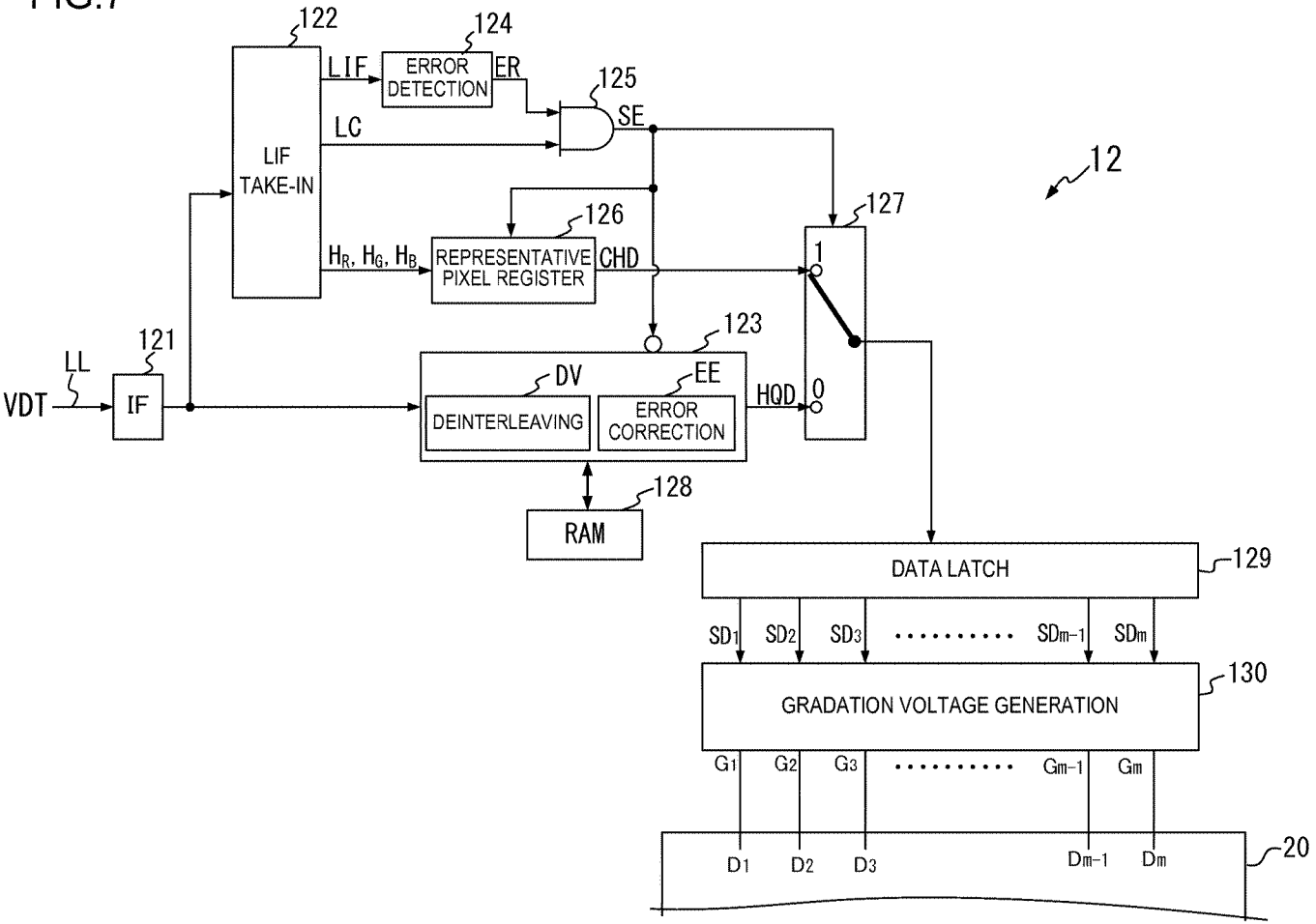
FIG. 7 is a block diagram illustrating an internal configuration of a data driver 12.

FIG. 7 is a block diagram illustrating one example of an internal configuration of the data driver 12. In FIG. 7, an interface unit 121 takes in the transmission image data signal VDT received via the transmission line LL at timing corresponding to a clock signal. The interface unit 121 then provides the transmission image data signal VDT to an LIF take-in unit 122 and a data decoding unit 123.

The LIF take-in unit 122 takes in the line information LIF from the transmission image data signal VDT shown in FIG. 6. The LIF take-in unit 122 then provides the line information LIF shown in FIG. 5 to an error detecting unit 124 and provides the identical color line data LC in the line information LIF to an AND gate 125. Furthermore, the LIF take-in unit 122 provides the representative red pixel data $H_B$, the representative green pixel data $H_G$, and the representative blue pixel data $H_B$ in the line information LIF shown in FIG. 5 to a representative pixel register 126.

The error detecting unit 124 detects whether there is an error bit in the sequence constituted by the identical color line data LC, the representative red pixel data $H_B$, the representative green pixel data $H_G$, and the representative blue pixel data $H_B$ contained in the line information LIF on the basis of the error check data CRC contained in the line information LIF. If there is an error bit, the error detecting unit 124 provides an error detection signal ER at a logic level of 0 to the AND gate 125. If there is no error bit, the error detecting unit 124 provides an error detection signal ER at a logic level of 1 to the AND gate 125.

If both of the error detection signal ER and the identical color line data LC are at the logic level of 1, the AND gate 125 generates an identical pixel line signal SE at a logic level of 1. If at least one of the error detection signal ER and the identical color line data LC is at the logic level of 0, the AND gate 125 generates an identical pixel line signal SE at a logic level of 0. In other words, if the line information LIF has no error and the identical color line data LC contained in the line information LIF indicates "identical-color-throughout-one-line", the AND gate 125 generates the identical pixel line signal SE at the logic level of 1. On the other hand, if the line information LIF has an error or the identical color line data LC does not indicate "identical-color-throughout-one-line", the AND gate 125 generates the identical pixel line signal SE at the logic level of 0.

The AND gate 125 provides the identical pixel line signal SE to the data decoding unit 123, the representative pixel register 126, and a selector 127.

When being supplied with the identical pixel line signal SE at the logic level of 0, the data decoding unit 123 is set in a state to perform the following decoding process. When being supplied with the identical pixel line signal SE at the logic level of 1, the data decoding unit 123 has a deinterleaving circuit DV and an error correction circuit EE set in an operation stopped state.

The deinterleaving circuit DV performs, on the coded data block ILV in the transmission image data signal VDT shown in FIG. 6, a deinterleaving process to restore the data array thereof. The deinterleaving circuit DV thereby restores the coded data block CDD constituted by the pixel data block HQD and the error correction code data ERR. For example, the deinterleaving circuit DV first writes the coded data block ILV in a first processing region of a RAM (Random Access Memory) 128 temporarily. The deinterleaving circuit DV reads out the coded data block ILV in a divided manner from the first processing region. The deinterleaving circuit DV then writes a data block recombined so as to have the same data arrangement as the pixel data block HQD and the error correction code data ERR shown in FIG. 6 in a second processing region. Thus, the coded data block CDD constituted by the pixel data block HQD and the error correction code data ERR, which has been restored by the deinterleaving process, is kept in the second processing region of the RAM 128. The deinterleaving circuit DV provides the pixel data block HQD and the error correction code data ERR kept in the second processing region of the RAM 128 to the error correction circuit EE. The RAM 128 includes a region for keeping intermediate data generated during the following error detection and error correction process in addition to the first and second processing regions used in the above-described deinterleaving process.

The error correction circuit EE performs an error detection and error correction process on the coded data block CDD restored by the deinterleaving circuit DV. At this time, the intermediate data generated during the error detection and error correction process is written into the RAM 128 and read out therefrom as needed. The error correction circuit EE corrects an error generated in the coded data block CDD by means of the error detection and error correction process and thereby restores the sequence of the pixel data $QD_1$ to $QD_m$ for one horizontal scanning line shown in FIG. 6. The pixel data block HQD constituted by the restored pixel data $QD_1$ to $QD_m$ is thus obtained.

The data decoding unit 123 provides, to the selector 127, the pixel data block HQD obtained by performing the decoding process, i.e., the deinterleaving process and the error correction process, on the received transmission image data signal VDT as described above.

The representative pixel register 126 keeps the single piece of representative red pixel data $H_R$, the single piece of representative green pixel data $H_G$, and the single piece of representative blue pixel data $H_B$ provided by the LIF take-in unit 122. When being supplied with the identical pixel line signal SE at the logic level of 1, the representative pixel register 126 performs the following readout operation.

Figure 8:
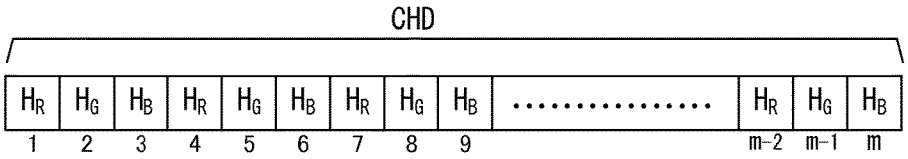
FIG. 8 is a diagram illustrating a data format of a pixel data block CHD sent out from a representative pixel data register 126.

More specifically, the representative pixel register 126 repeatedly reads out the stored representative red pixel data $H_R$, representative green pixel data $H_G$, and representative blue pixel data $H_B$ for one horizontal scanning line as shown in FIG. 8 in a cyclic manner in the order of $H_R$, $H_G$, and $H_B$. The representative pixel register 126 provides a pixel data block CHD constituted by the thus read out m pieces of $H_R$, $H_G$, and $H_B$ for one horizontal scanning line to the selector 127.

When being supplied with the identical pixel line signal SE at the logic level of 0, the representative pixel register 126 is set in the operation stopped state.

The selector 127 alternatively selects one of the pixel data block CHD provided by the representative pixel register 126 and the pixel data block HQD provided by the data decoding unit 123 that is indicated by the identical pixel line signal SE. More specifically, if the identical pixel line signal SE indicates the logic level of 0, the selector 127 selects the pixel data block HQD. If the identical pixel line signal SE indicates the logic level of 1, the selector 127 selects the pixel data block CHD. The selector 127 provides the thus selected one of the pixel data blocks HQD and CHD to a data latch 129.

More specifically, in response to the identical pixel line signal SE at the logic level of 0 that does not indicate identical-color-throughout-one-line, the selector 127 provides the pixel data block HQD, which has been decoded by the data decoding unit 123, to the data latch 129. In response to the identical pixel line signal SE at the logic level of 1 that indicates identical-color-throughout-one-line, the selector 127 provides the pixel data block CHD constituted by the representative pixel data pieces group ($H_R$, $H_G$, and $H_B$) to the data latch 129.

The data latch 129 sequentially takes in the m pieces of pixel data (QD or H) for one horizontal scanning line contained in the pixel data block HQD or CHD. The data latch 129 then provides these data pieces to a gradation voltage generating unit 130 as pixel data $SD_1$ to $SD_m$.

The gradation voltage generating unit 130 converts the pixel data $SD_1$ to $SD_m$ to analog gradation voltages corresponding to luminance levels indicated by the pixel data $SD_1$ to $SD_m$. The gradation voltage generating unit 130 then applies the gradation voltages corresponding to the pixel data $SD_1$ to $SD_m$ to the data lines $D_1$ to $D_m$ of the display panel 20 as the pixel driving voltages $G_1$ to $G_m$, respectively.

With the above-described configuration, the data driver 12 obtains one of the pixel data blocks HQD and CHD on the basis of the received transmission image data signal VDT shown in FIG. 6. If the line information LIF contained in the transmission image data signal VDT has an error (ER=0) or the identical color line data LC contained in the line information LIF does not indicate identical-color-throughout-one-line (LC=0), the data driver 12 generates the pixel data block HQD. More specifically, in this case, the data decoding unit 123 performs the deinterleaving process and the error correction process on the coded data block ILV in the transmission image data signal VDT to restore the pixel data block HQD constituted by the pixel data $QD_1$ to $QD_m$ shown in FIG. 6. The selector 127 then provides such a pixel data block HQD to the data latch 129, thereby allowing the data latch 129 to take in the pixel data $QD_1$ to $QD_m$ for one horizontal scanning line, which is contained in the pixel data block HQD. Consequently, the gradation voltage generating unit 130 generates the analog pixel driving voltages $G_1$ to $G_m$ corresponding to the pixel data $QD_1$ to $QD_m$ shown in FIG. 6, respectively, and applies these voltages $G_1$ to $G_m$ to the data lines $D_1$ to $D_m$ of the display panel 20, respectively.

If the line information LIF has no error (ER=1) and the identical color line data LC indicates identical-color-throughout-one-line (LC=1), the data driver 12 generates the pixel data block CHD on the basis of the received transmission image data signal VDT. More specifically, in this case, the representative pixel register 126 repeatedly reads out the single piece of representative red pixel data $H_R$, the single piece of representative green pixel data $H_G$, and the single piece of representative blue pixel data $H_B$ contained in the line information LIF in a cyclic manner in the order of $H_R$, $H_G$, and $H_B$ as shown in FIG. 8. The representative pixel register 126 thus generates the pixel data block CHD in which the representative red pixel data $H_R$, the representative green pixel data $H_G$, and the representative blue pixel data $H_B$ are repeatedly arranged over one horizontal scanning line. The selector 127 then provides such a pixel data block CHD to the data latch 129, thereby allowing the data latch 129 to take in the representative red pixel data $H_R$, the representative green pixel data $H_G$, and the representative blue pixel data $H_B$ for one horizontal scanning line, which are contained in the pixel data block CHD. Consequently, on the basis of the representative red pixel data $H_R$, the representative green pixel data $H_G$, and the representative blue pixel data $H_B$, the gradation voltage generating unit 130 generates the analog pixel driving voltages $G_1$ to $G_m$ for causing one horizontal scanning line to have the identical color. The gradation voltage generating unit 130 then applies these voltages $G_1$ to $G_m$ to the data lines $D_1$ to $D_m$ of the display panel 20, respectively.

As described above, according to the display device shown in FIG. 1, the drive control unit 10 transmits the transmission image data signal VDT, which has been obtained by performing the error correction coding process and the interleaving process on the input image data VD, to the data driver 12 via the transmission line LL. At this time, the data driver 12 performs the deinterleaving process and the error correction process on the received transmission image data signal VDT. This allows the data driver 12 to restore the sequence of the pixel data QD indicated by the input image data VD from the received transmission image data signal VDT. The data latch 129 takes in the restored sequence of the pixel data QD by an amount corresponding to one horizontal scanning line (m pieces) at a time.

Thus, according to such a configuration, even when an error is generated in the transmission image data signal VDT received at the data driver 12 due to the influence of the EMI caused by an increase in the transmission frequency of the image data signal, such an error can be corrected on the side of the data driver 12. Thus, even under the EMI environment resulting from an increase in the frequency of the image data signal, the display quality can be prevented from deteriorating.

Furthermore, if there are the pixel data $QD_1$ to $QD_m$ that cause the respective pixels PX on one horizontal scanning line to display an identical color in the input image data VD, the drive control unit 10 first selects three pieces of pixel data for forming that color as the representative pixel data ($H_R$, $H_G$, and $H_B$) from among such pixel data $QD_1$ to $QD_m$. The drive control unit 10 then transmits, to the data driver 12, the transmission image data signal VDT as shown in FIG. 6 including the line information LIF containing the identical color line data LC indicating whether the pixels on one horizontal scanning line have the identical color as well as the representative pixel data $H_R$, $H_G$, and $H_B$.

If the identical color line data LC indicates that the pixels on one horizontal scanning line have the identical color, the data driver 12 performs the following process without performing the deinterleaving process and the error correction process on the received transmission image data signal VDT. More specifically, the representative red pixel data $H_R$, the representative green pixel data $H_G$, and the representative blue pixel data $H_B$ contained in the line information LIF are repeated over one horizontal scanning line (m pieces) and the data latch 129 is caused to take in such pixel data.

Thus, according to such a configuration, if all pixels on one horizontal scanning line have the identical color, no deinterleaving process and error correction process described above are performed on the received transmission image data signal VDT and no access to the RAM 128, associated with such processes, is performed. Thus, amounts of power consumption and heat generation can be reduced by amounts caused by performing the deinterleaving process, the error correction process, and the access to the RAM 128.

As described above, the display device shown in FIG. 1 can suppress an increase in amounts of power consumption and heat generation without deteriorating the display quality thereof even when the transmission frequency of the image data signal in the display device becomes higher as the display panel has higher definition.

According to the configuration of the data driver 12 shown in FIG. 7, a data reception operation, covering from the reception of the transmission image data signal VDT to the sending of the pixel data group for one horizontal scanning line to the data latch 129, is performed by hardware (121 to 127). However, such a data reception operation may be performed by software.

Figure 9:
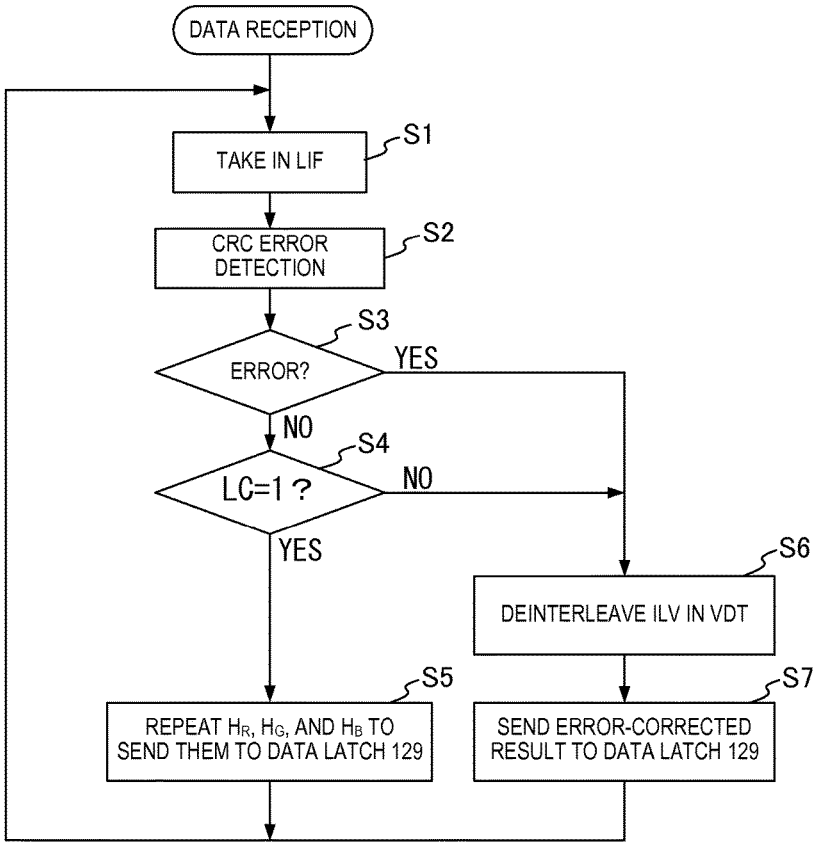
FIG. 9 is a flowchart showing a data reception control routine to be performed in the data driver 12.

FIG. 9 is a flowchart showing a data reception control routine created in view of the above point and to be performed by a control unit (not shown) in the data driver 12.

In FIG. 9, the control unit of the data driver 12 first takes in the line information LIF shown in FIG. 5 from the received transmission image data signal VDT (step S1). Next, on the basis of the error check data CRC contained in the line information LIF as shown in FIG. 5, the control unit performs the error detection process on the line information LIF (step S2) to determine whether or not there is an error (step S3). If it is determined that there is no error in step S3, the control unit then determines whether or not the identical color line data LC contained in the line information LIF has the logic level of 1 indicating that the pixels on one horizontal scanning line have an identical color (step S4). If it is determined in step S4 that the identical color line data LC has the logic level of 1, the control unit repeats the representative red pixel data $H_R$, the representative green pixel data $H_G$, and the representative blue pixel data $H_B$ contained in the line information LIF as shown in FIG. 5 over one horizontal scanning line (m pieces) to send these data to the data latch 129 (step S5).

If it is determined in step S3 that the line information LIF has an error or the identical color line data LC has the logic level of 0 indicating that not all pixels on one horizontal scanning line have an identical color, the control unit performs the following step S6. More specifically, the control unit performs the deinterleaving process on the coded data block ILV shown in FIG. 6 in the received transmission image data signal VDT to restore the coded data block CDD constituted by the pixel data $QD_1$ to $QD_m$ and the error correction code data ERR shown in FIG. 6 (step S6). Then, the control unit performs the error correction process on such a coded data block CDD to obtain the error-corrected pixel data $QD_1$ to $QD_m$ and sends out these data to the data latch 129 (step S7).

The control unit of the data driver 12 performs the control made up of the above steps S1 to S5 or S1 to S4, S6, and S7 on the received transmission image data signal VDT for each horizontal scanning line.

In sum, according to the display device shown in FIG. 1, the control unit 10 first generates the transmission image data signal VDT on the basis of the input image data VD and transmits the transmission image data signal VDT to the driver 12 as will be described below.

The control unit 10 includes: the identical color line detecting unit (101*x* and 101*a* to 101*f*); the representative pixel extracting unit (101*a* and 101*c*); the error correction coding unit 102; and the transmitting unit 104. The identical color line detecting unit generates, for each horizontal scanning line, the identical color line data LC indicating whether or not the pixels for one horizontal scanning line have an identical color on the basis of the sequence of the pixel data pieces in the input image data. The representative pixel extracting unit extracts, as a representative pixel data pieces group, three pixel data pieces ($H_R$, $H_G$, and $H_B$)

corresponding to red, green, and blue, respectively, from among the sequence of the pixel data pieces. The error correction coding unit performs the error correction coding process on the sequence of the pixel data pieces to generate the coded data block CDD. The transmitting unit generates the transmission image data signal including the above-described identical color line data, representative pixel data pieces group, and coded data block and transmits such a signal to the driver.

If the identical color line data in the received transmission image data signal indicates not having the identical color, the driver 12 converts the pixel data pieces obtained by performing the error correction process (EE) on the coded data block in the transmission image data signal to pixel driving voltages (130) and applies these voltages to the plurality of data lines $D_1$ to $D_m$ in the display panel 20. If the identical color line data indicates having the identical color, on the other hand, the driver 12 converts the pixel data pieces contained in the representative pixel data pieces group in the transmission image data signal to pixel driving voltages and applies these voltages to the plurality of data lines in the display panel.

In the high-definition mode, if all pixels for one horizontal scanning line have an identical color, the identical color line detecting unit determines that the pixels for one horizontal scanning line have the identical color. In the low power consumption mode, if all of color differences between the reference color most frequent among colors expressed by respective pixels for one horizontal scanning line and the colors expressed by the respective pixels for one horizontal scanning line fall within a predetermined range, the identical color line detecting unit determines that the pixels for one horizontal scanning line have an identical color.

This application is based on a Japanese Patent Application No. 2014-167003 which is hereby incorporated by reference.

What is claimed is:

1. A display device for displaying, on a display panel having data lines, an image based on input image data including a sequence of pixel data pieces indicating luminance levels corresponding to red, green, and blue of respective pixels, the display device comprising:

a driver configured to apply pixel driving voltages to said data lines per a respective one of horizontal scanning lines; and a control unit configured to generate a transmission image data signal on the basis of the input image data and transmit the transmission image data signal to the driver, wherein said control unit includes:

an identical color line detecting unit configured to detect, for each of said horizontal scanning lines, whether or not pixels for one horizontal scanning line have an identical color display state on the basis of said sequence of the pixel data pieces in said input image data so as to generate identical color line data indicating a detecting result;

a representative pixel extracting unit configured to extract, as a representative pixel data pieces group, three pixel data pieces corresponding to red, green, and blue, respectively, from among the sequence of the pixel data pieces;

an error correction coding unit configured to perform an error correction coding process on the sequence of the pixel data pieces to generate a coded data block; and a transmitting unit configured to generate the transmission image data signal, the transmission image data signal including said identical color line data, the representative pixel data pieces group, and the coded data block, and transmit the transmission image data signal to the driver, wherein if said identical color line data in the transmission image data signal received indicates the pixels for the one horizontal scanning line not having said identical color display state, said driver converts pixel data pieces obtained by performing an error correction process on said coded data block in the transmission image data signal to respective pixel driving voltages, and wherein if said identical color line data indicates the pixels for the one horizontal scanning line having said identical color display state, said driver converts, without performing said error correction process on said coded data block, the pixel data pieces contained in the representative pixel data pieces group in the transmission image data signal to the respective pixel driving voltages.

2. The display device according to claim 1, wherein the control unit includes an interleaving unit for performing an interleaving process on the coded data block, the driver includes: an error correction circuit for performing the error correction process; and a deinterleaving circuit for performing a deinterleaving process, and the error correction circuit and the deinterleaving circuit are set in an operation stopped state when the identical color line data indicates the pixels for the one horizontal scanning line having the identical color display state.

3. The display device according to claim 1, wherein the driver includes a register for keeping the representative pixel data pieces group, and if the identical color line data indicates the pixels for the one horizontal scanning line having the identical color display state, the register repeatedly reads out the representative pixel data pieces group for the one horizontal scanning line.

4. The display device according to claim 1, wherein the control unit transmits, to the driver, in the transmission image data signal, error check data obtained by performing an error detection coding process on a data sequence constituted by the identical color line data and the representative pixel data pieces group, the driver includes an error detecting unit for performing an error detection process on a data sequence constituted by the identical color line data and the representative pixel data pieces group on the basis of the error check data contained in the transmission image data signal, if an error is detected by the error detection process or the identical color line data indicates the pixels for the one horizontal scanning line not having the identical color display state, the driver converts the pixel data pieces obtained by performing the error correction process on the coded data block in the transmission image data signal to the respective pixel driving voltages, and if no error is detected by the error detection process and the identical color line data indicates the pixels for the one horizontal scanning line having the identical color display state, the driver converts the pixel data pieces contained in the representative pixel data pieces group in the transmission image data signal to the respective pixel driving voltages.

5. The display device according to claim 1, wherein in a high-definition mode, the identical color line detecting unit generates the identical color line data on the basis of the sequence of the pixel data pieces in the input image data, and in a low power consumption mode, the identical color line detecting unit: sets, for each horizontal scanning line, a color most frequent among colors expressed by the respective pixels as a reference color on the basis of the input image data; determines, for each of the pixels, a color difference between the reference color and the color expressed by the pixel; and generates, if the color difference falls within a predetermined range, the identical color line data on the basis of the input image data having undergone correction of replacing luminance levels of the pixel data pieces for red, green, and blue color components corresponding to the pixel with luminance levels for red, green, and blue color components in the reference color, respectively.

6. The display device according to claim 5, wherein in the low power consumption mode, if there are a plurality of most frequent colors among the colors expressed by the pixels for one horizontal scanning line, an average color of the pixels for one horizontal scanning line is set as the reference color.

7. A transmission processing method for an image data signal in a display device for displaying, on a display panel, an image based on input image data including a sequence of pixel data pieces indicating luminance levels corresponding to red, green, and blue of respective pixels, the method comprising:

a first step of detecting, for each of horizontal scanning lines, whether or not pixels for one horizontal scanning line have an identical color display state on the basis of said sequence of the pixel data pieces in said input image data so as to generate identical color line data indicating a detecting result;

a second step of extracting, as a representative pixel data pieces group, three pixel data pieces corresponding to red, green, and blue, respectively, from among the sequence of the pixel data pieces;

a third step of performing an error correction coding process on the sequence of the pixel data pieces to generate a coded data block;

a fourth step of generating a transmission image data signal including said identical color line data, the representative pixel data pieces group, and the coded data block;

a fifth step of determining whether said identical color line data in the transmission image data signal indicates the pixels for the one horizontal scanning line having said identical color display state or the pixels for the one horizontal scanning line not having said identical color display state; and a sixth step of converting, if said identical color line data indicates the pixels for the one horizontal scanning line not having said identical color display state, pixel data pieces obtained by performing an error correction process on the coded data block in the transmission image data signal to respective pixel driving voltages and applying the respective pixel driving voltages to the display panel or converting, if said identical color line data indicates the pixels for the one horizontal scanning line having said identical color display state, the pixel data pieces contained in the representative pixel data pieces group in the transmission image data signal, without performing said error correction process on said coded data block, to the respective pixel driving voltages and applying the respective pixel driving voltages to the display panel.

8. The transmission processing method for an image data signal according to claim 7, wherein in the second step, an interleaving process is performed on the coded data block, and in the sixth step, if the identical color line data indicates the pixels for the one horizontal scanning line not having the identical color display state, a deinterleaving process and the error correction process are performed on the coded data block in the transmission image data signal.

9. The transmission processing method for an image data signal according to claim 7, wherein in the sixth step, if the identical color line data indicates the pixels for the one horizontal scanning line having the identical color display state, the representative pixel data pieces group is kept in a register, and the representative pixel data pieces group is repeatedly read out from the register for the one horizontal scanning line.

10. The transmission processing method for an image data signal according to claim 7, wherein in the fourth step, error check data obtained by performing an error detection coding process on a data sequence constituted by the identical color line data and the representative pixel data pieces group is included in the generated transmission image data signal, in the sixth step, if an error is detected as a result of an error detection process performed on the data sequence constituted by the identical color line data and the representative pixel data pieces group on the basis of the error check data contained in the transmission image data signal or if the identical color line data indicates the pixels for the one horizontal scanning line not having the identical color display state, the pixel data pieces obtained by performing the error correction process on the coded data block in the transmission image data signal are converted to the respective pixel driving voltages, and if the error is not detected and the identical color line data indicates the pixels for the one horizontal scanning line having the identical color display state, the pixel data pieces contained in the representative pixel data pieces group in the transmission image data signal are converted to the respective pixel driving voltages.

11. The transmission processing method for an image data signal according to claim 7, wherein in the first step, in a high-definition mode, the identical color line data is generated on the basis of the sequence of the pixel data pieces in the input image data, and in a low power consumption mode, a color most frequent among colors expressed by the pixels is set as a reference color for each horizontal scanning line on the basis of the input image data; for each of the pixels, a color difference between the reference color and the color expressed by the pixel is determined; and if the color difference falls within a predetermined range, the identical color line data is generated on the basis of the input image data having undergone correction of replacing luminance levels of the pixel data pieces for red, green, and blue color components corresponding to the pixel with luminance levels for red, green, and blue color components in the reference color, respectively.

12. The transmission processing method for an image data signal according to claim 11, wherein in the low power consumption mode, if there are a plurality of most frequent colors among the colors expressed by the pixels for one horizontal scanning line, an average color of the pixels for one horizontal scanning line is set as the reference color.

* * * * *